US010923337B2

(12) United States Patent
Shichi

(10) Patent No.: US 10,923,337 B2
(45) Date of Patent: Feb. 16, 2021

(54) ION TRAP MASS SPECTROMETER AND ION TRAP MASS SPECTROMETRY METHOD

(71) Applicant: Shimadzu Corporation, Kyoto (JP)

(72) Inventor: Hideharu Shichi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 16/599,500

(22) Filed: Oct. 11, 2019

(65) Prior Publication Data

US 2020/0185208 A1 Jun. 11, 2020

(30) Foreign Application Priority Data

Dec. 5, 2018 (JP) ..... JP2018-228514

(51) Int. Cl.
*H01J 49/00* (2006.01)
*H01J 49/42* (2006.01)
*H01J 49/02* (2006.01)

(52) U.S. Cl.
CPC ..... *H01J 49/025* (2013.01); *H01J 49/022* (2013.01)

(58) Field of Classification Search
CPC ..... H01J 49/025; H01J 49/0022; H01J 49/26; H01J 49/28
USPC ..... 250/281, 282, 283, 288
See application file for complete search history.

(56) References Cited

U.S. PATENT DOCUMENTS

2003/0222211 A1* 12/2003 Okumura et al. .... H01J 49/004 250/287
2005/0127290 A1* 6/2005 Hashimoto et al. .. H01J 49/401 250/288
2007/0114376 A1* 5/2007 Hager ..... H01J 49/42 250/282
2009/0057548 A1 3/2009 Hidalgo et al.
2010/0065740 A1 3/2010 Iwamoto et al.
2010/0084549 A1* 4/2010 Ermakov ..... H01J 49/4245 250/283
2010/0116982 A1 5/2010 Iwamoto et al.
2012/0119083 A1 5/2012 Kodera et al.
(Continued)

FOREIGN PATENT DOCUMENTS

JP 2013-104741 A 5/2013
JP 2014-225339 A 12/2014
(Continued)

OTHER PUBLICATIONS

Extended European Search Report dated Feb. 27, 2020 in European Patent Application No. 19192367.1, 8 pages.

*Primary Examiner* — Nicole M Ippolito
(74) *Attorney, Agent, or Firm* — Oblon, McClelland, Maier & Neustadt, L.L.P.

(57) ABSTRACT

An ion source of an ion trap mass spectrometer generates ions of a component in a sample. An ion trap captures the ions generated by the ion source. An ion detector detects ions ejected from the ion trap. A voltage application control part changes a voltage applied to the ion detector such that, after generation of ions by the ion source is started, ion detection capability of the ion detector during a time period when ions having a mass-to-charge ratio outside an analysis target range are ejected from the ion trap is lower as compared to ion detection capability of the ion detector during a time period when ions having a mass-to-charge ratio within the analysis target range are ejected from the ion trap.

20 Claims, 6 Drawing Sheets

(56) References Cited

U.S. PATENT DOCUMENTS

| | | | | |
|---|---|---|---|---|
| 2014/0263999 | A1* | 9/2014 | Ramsey ..... | H01J 49/424<br>250/281 |
| 2019/0108993 | A1 | 4/2019 | Sekiya et al. | |

FOREIGN PATENT DOCUMENTS

| | | | |
|---|---|---|---|
| JP | 2018-077180 | A | 5/2018 |
| WO | WO 2008/126383 | A1 | 10/2008 |
| WO | WO 2008/129850 | A1 | 10/2008 |
| WO | WO 2010/116396 | A1 | 10/2010 |
| WO | WO 2017/126006 | A1 | 7/2017 |

* cited by examiner

ION TRAP MASS SPECTROMETER AND ION TRAP MASS SPECTROMETRY METHOD

BACKGROUND OF THE INVENTION

Field of the Invention

The present invention relates to an ion trap mass spectrometer and an ion trap mass spectrometry method.

Description of Related Art

An ion trap mass spectrometer using an ion trap that captures ions by an electric field is known. For example, in International Publication No. 2008/129850, a matrix assisted laser desorption ionization digital ion trap mass spectrometer (MALDI-DIT-MS) is described. In an ion trap mass spectrometer, ions are generated from a sample by irradiating a laser beam to the sample. After the generated ions are introduced into an ion trap and are captured therein, ions having a mass-to-charge ratio (m/z) of an analysis target range are ejected from the ion trap and are detected by an ion detector.

SUMMARY OF THE INVENTION

In an ion trap mass spectrometer, when ions are introduced into an ion trap and are captured therein, ions having a mass-to-charge ratio outside an analysis target range are not captured by the ion trap and are ejected from the ion trap, and are detected by an ion detector. The lifetime of the ion detector decreases as the number of detected ions increases. Therefore, it is desirable to suppress a decrease in the lifetime of the ion detector due to detection of ions outside the analysis target range.

A purpose of the present invention is to provide an ion trap mass spectrometer and an ion trap mass spectrometry method that allow the lifetime of an ion detector to be improved.

(1) An ion trap mass spectrometer according to one aspect of the present invention includes: an ion source that generates ions of a component in a sample; an ion trap that captures the ions generated by the ion source; an ion detector that detects ions ejected from the ion trap; and a voltage application control part that applies a voltage to the ion detector. The voltage application control part changes the voltage applied to the ion detector such that, after generation of ions by the ion source is started, ion detection capability of the ion detector during a time period when ions having a mass-to-charge ratio outside an analysis target range are ejected from the ion trap is lower as compared to ion detection capability of the ion detector during a time period when ions having a mass-to-charge ratio within the analysis target range are ejected from the ion trap.

According to the ion trap mass spectrometer, during the time period when the ions having a mass-to-charge ratio outside the analysis target range are ejected, the ion detection capability of the ion detector is low. As a result, the number of the ions outside the analysis target range detected by the ion detector is reduced. On the other hand, during the time period when the ions having a mass-to-charge ratio within the analysis target range are ejected, the ion detection capability of the ion detector is high. As a result, the ions in the analysis target range are surely detected. Therefore, deterioration of the ion detector due to ions outside the analysis target range is suppressed. As a result, the lifetime of the ion detector can be improved.

(2) The ion trap mass spectrometer may further include a cooling part that performs cooling of ions in the ion trap during a first cooling time period after generation of ions by the ion source is started. The voltage application control part may change the voltage applied to the ion detector such that the ion detection capability of the ion detector is increased during the first cooling time period and after a time period during which ions having a mass-to-charge ratio outside the analysis target range are ejected from the ion trap.

In this case, by changing the voltage applied to the ion detector during the first cooling time period, deterioration of the ion detector due to detection of ions outside the analysis target range can be suppressed.

(3) The ion trap mass spectrometer according to claim 1 may further include an ion dissociation part that dissociates precursor ions captured in the ion trap during a dissociation time period after the first cooling time period. The cooling part may perform cooling of ions in the ion trap during a second cooling time period after the dissociation time period, and the voltage application control part may change the voltage applied to the ion detector such that the ion detection capability of the ion detector is increased after a time period during which ions having a mass-to-charge ratio outside the analysis target range are ejected from the ion trap and until the second cooling time period ends.

In this case, deterioration of the ion detector due to detection of ions outside the analysis target range ejected from the ion trap in an MS/MS analysis can be suppressed.

(4) The voltage application control part may change the voltage applied to the ion detector such that the ion detection capability of the ion detector is increased after a time period during which ions generated along with selection and dissociation of precursor ions during the dissociation time period are ejected from the ion trap, or during the second cooling time period.

In this case, deterioration of the ion detector due to detection of ions generated along with selection and dissociation of precursor ions can be suppressed.

(5) The ion detector may include a dynode that converts ions to charges, and a secondary electron multiplier tube that detects an amount of the charges converted by the dynode. The voltage application control part may apply equal voltages to the dynode and the secondary electron multiplier tube during a time period when ions having a mass-to-charge ratio outside the analysis target range are ejected from the ion trap, and may apply different voltages to the dynode and the secondary electron multiplier tube such that charges move from the dynode to the secondary electron multiplier tube during a time period when ions having a mass-to-charge ratio within the analysis target range are ejected from the ion trap.

In this case, since the number of ions entered into the dynode is reduced, the number of charges entered into the secondary electron multiplier tube is reduced. As a result, deterioration of the secondary electron multiplier tube is suppressed.

(6) The voltage application control part may apply a constant voltage to the secondary electron multiplier tube, and may change a voltage applied to the dynode in order to increase the ion detection capability of the ion detector.

In this case, since the ion detection capability of the ion detector is instantly increased by changing the voltage applied to the dynode, it is not necessary to consider a time period for stabilizing characteristics of the secondary electron multiplier tube.

(7) An ion trap mass spectrometry method according to another aspect of the present invention includes: a step of generating ions of a component in a sample; a step of capturing the generated ions by an ion trap; a step of detecting ions ejected from the ion trap by an ion detector; and a step of changing a voltage applied to the ion detector such that, after generation of ions by an ion source is started, ion detection capability of the ion detector during a time period when ions having a mass-to-charge ratio outside an analysis target range are ejected from the ion trap is lower as compared to ion detection capability of the ion detector during a time period when ions having a mass-to-charge ratio within the analysis target range are ejected from the ion trap.

According to the ion trap mass spectrometry method, deterioration of the ion detector due to ions outside the analysis target range is suppressed. Therefore, the lifetime of the ion detector can be improved.

DESCRIPTION OF THE PREFERRED EMBODIMENT

In the following, an ion trap mass spectrometer and an ion trap mass spectrometry method according to an embodiment of the present invention is described in detail with reference to the drawings.

(1) Structure of the Ion Trap Mass Spectrometer

Figure 1:
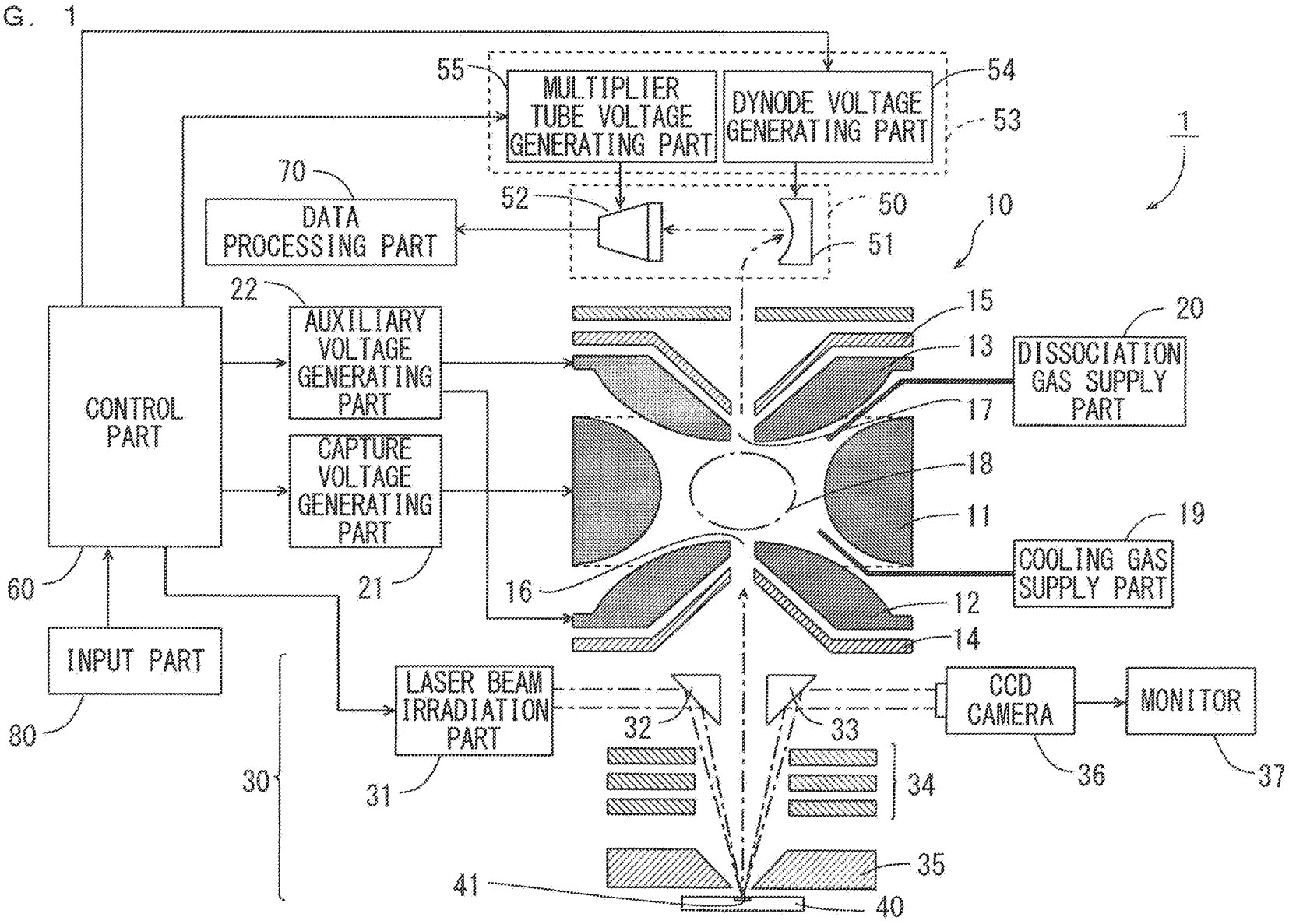
FIG. 1 is a schematic diagram illustrating a structure of an ion trap mass spectrometer according to an embodiment of the present invention.

FIG. 1 is a schematic diagram illustrating a structure of an ion trap mass spectrometer according to an embodiment of the present invention. An ion trap mass spectrometer 1 of FIG. 1 is a matrix assisted laser desorption ionization digital ion trap mass spectrometer (MALDI-DIT-MS).

The ion trap mass spectrometer 1 includes an ion trap 10, an ion source 30, an ion detector 50, a control part 60, a data processing part 70 and an input part 80. In the present embodiment, the ion trap 10 is a three-dimensional quadrupole ion trap. The ion trap 10 includes a ring electrode 11, a pair of end cap electrodes (12, 13), an inlet side electric field correction electrode 14 and an extraction electrode 15. The pair of end cap electrodes (12, 13) are provided opposing each other so as to sandwich the ring electrode 11. An ion inlet 16 is provided substantially at a center of the end cap electrode 12. The inlet side electric field correction electrode 14 is provided on an outer side of the end cap electrode 12 in order to prevent disturbance in an electric field near the ion inlet 16. An ion outlet 17 is provided substantially at a center of the end cap electrode 13. The extraction electrode 15 is provided on an outer side of the end cap electrode 13 in order to extract ions to the ion detector 50 through the ion outlet 17.

Further, the ion trap mass spectrometer 1 includes a cooling gas supply part 19, a dissociation gas supply part 20, a capture voltage generating part 21 and an auxiliary voltage generating part 22. The cooling gas supply part 19 supplies into the ion trap 10 a cooling gas for cooling ions inside the ion trap 10. The cooling gas is an inert gas such as a helium gas. In the present embodiment, the cooling gas supply part 19 is an example of a cooling part. The dissociation gas supply part 20 supplies into the ion trap 10 a dissociation gas for collision induced dissociation (CID) in MS/MS. The dissociation gas is an inert gas such as a helium gas. In the present embodiment, the dissociation gas supply part 20 is an example of a dissociation part. The capture voltage generating part 21 applies a rectangular wave voltage to the ring electrode 11. The auxiliary voltage generating part 22 applies a predetermined DC voltage or AC voltage to the end cap electrodes (12, 13).

In the present embodiment, the ion source 30 is an MALDI ion source. The ion source 30 includes a laser beam irradiation part 31, reflecting mirrors (32, 33), an einzel lens 34 and an aperture 35. A sample 41 mixed with a matrix is prepared on a sample plate 40. The laser beam irradiation part 31 emits a laser beam. The reflecting mirror 32 reflects and converges the laser beam emitted by the laser beam irradiation part 31 to irradiate the sample 41. As a result, a component of the sample 41 is ionized. The einzel lens 34 transports ions generated from the sample 41 to the ion trap 10. As an ion transport optical system, instead of the einzel lens 34, other ion transport optical systems such as an electrostatic lens optical system may also be used. The aperture 35 blocks ions diffusing from the ion trap 10.

In the present embodiment, the ion source 30 includes a CCD (charge coupled device) camera 36 and a monitor 37. The sample 41 is imaged by the CCD camera 36 via the reflecting mirror 33, and an observation image of the sample 41 obtained by the CCD camera 36 is displayed on the monitor 37.

The ion detector 50 is arranged on an outer side of the ion outlet 17. Ions ejected from the ion outlet 17 are introduced into the ion detector 50. The ion detector 50 includes a conversion dynode (hereinafter, abbreviated as a dynode) 51 and a secondary electron multiplier tube 52. A detector voltage is applied to the ion detector 50 by the detector voltage generating part 53.

The detector voltage generating part 53 includes a dynode voltage generating part 54 and a secondary electron multiplier tube voltage generating part (hereinafter, abbreviated as a multiplier tube voltage generating part) 55. The dynode voltage generating part 54 applies a dynode voltage to the dynode 51. The multiplier tube voltage generating part 55 applies a multiplier tube voltage to the secondary electron multiplier tube 52. In the present embodiment, the detector voltage includes the dynode voltage and the multiplier tube voltage. The dynode 51 converts ions to charges (electrons or positive charges). The secondary electron multiplier tube 52 detects an amount of the ions by multiplying the charges converted by the dynode 51. The detector voltage generating part 53 switches the detector voltage between a first state and a second state (to be described later) based on control of the control part 60. In the present embodiment, the detector voltage generating part 53 and the control part 60 are an example of a voltage application control part.

A detection signal output from the ion detector 50 is supplied to the data processing part 70. The data processing part 70 generates a mass spectrum based on the detection signal supplied from the ion detector 50.

The control part 60 is formed by a CPU (central processing unit), a RAM (random access memory), a ROM (read only memory) and a storage device. The control part 60 controls the laser beam irradiation part 31, the cooling gas supply part 19, the dissociation gas supply part 20, the capture voltage generating part 21, the auxiliary voltage generating part 22, the dynode voltage generating part 54 and the multiplier tube voltage generating part 55.

(2) Detector Voltage Applied to the Ion Detector 50

Figure 2:
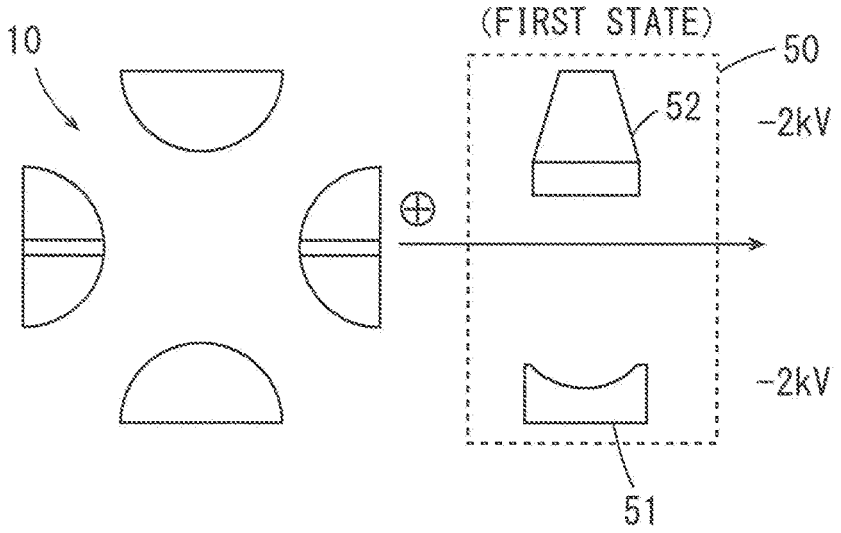
FIG. 2 is a schematic diagram illustrating an example of a first state of a detector voltage.
Figure 3:
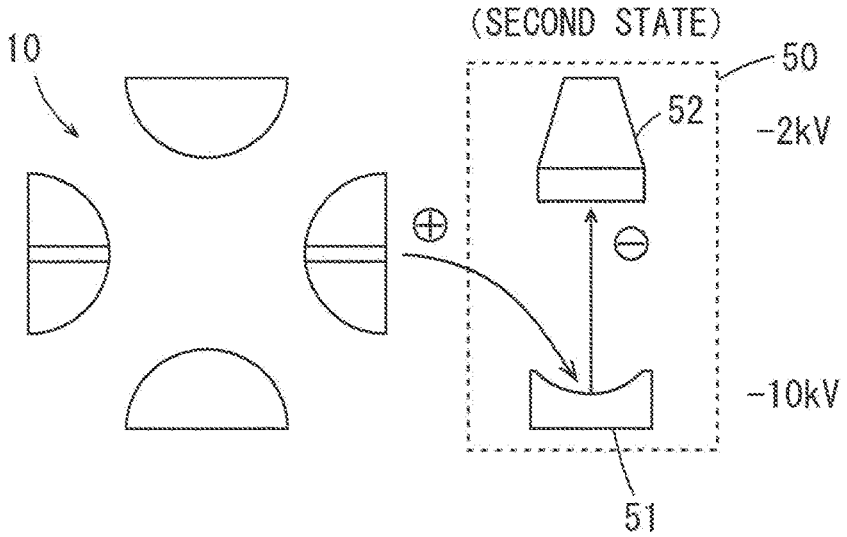
FIG. 3 is a schematic diagram illustrating an example of a second state of the detector voltage.

FIG. 2 is a schematic diagram illustrating an example of the first state of the detector voltage. FIG. 3 is a schematic diagram illustrating an example of the second state of the detector voltage. In the examples of FIGS. 2 and 3 and an example of FIG. 4 (to be described later), a case where positive ions are detected is described.

As illustrated in FIG. 2, in the first state of the detector voltage, the dynode voltage applied to the dynode 51 and the multiplier tube voltage applied to the secondary electron multiplier tube 52 are equal to each other. In the example of FIG. 2, the dynode voltage and the multiplier tube voltage are equal negative voltages (for example, −2 kV). In the first state, positive ions ejected from the ion outlet 17 of the ion trap 10 pass through between the dynode 51 and the secondary electron multiplier tube 52 of the ion detector 50, and do not enter into the dynode 51. Therefore, electrons hardly enter into the secondary electron multiplier tube 52. Therefore, ions ejected from the ion trap 10 are hardly detected by the ion detector 50. That is, ion detection capability of the ion detector 50 is low. Here, the ion detection capability of the ion detector 50 means a degree of an amount of charges detected by the ion detector 50 when a certain number of ions enter into the ion detector 50. Specifically, the ion detection capability corresponds to a ratio of the number of charges entered into the secondary electron multiplier tube 52 to the number of ions entered into the ion detector 50.

As illustrated in FIG. 3, in the second state of the detector voltage, the dynode voltage applied to the dynode 51 and the multiplier tube voltage applied to the secondary electron multiplier tube 52 are different from each other. In the example of FIG. 3, the dynode voltage is a negative voltage (for example, −10 kV) lower than the multiplier tube voltage. In the second state, positive ions ejected from the ion outlet 17 of the ion trap 10 enter into the dynode 51 of the ion detector 50. As a result, the positive ions are converted to electrons by the dynode 51. The electrons generated by the dynode 51 enter into the secondary electron multiplier tube 52. Therefore, ions ejected from the ion trap 10 are detected by the ion detector 50. That is, the ion detection capability of the ion detector 50 is high.

As described above, the ion detection capability of the ion detector 50 in the case where the detector voltage is in the second state is higher than the ion detection capability of the ion detector 50 in the case where the detector voltage is in the first state.

Figure 4:
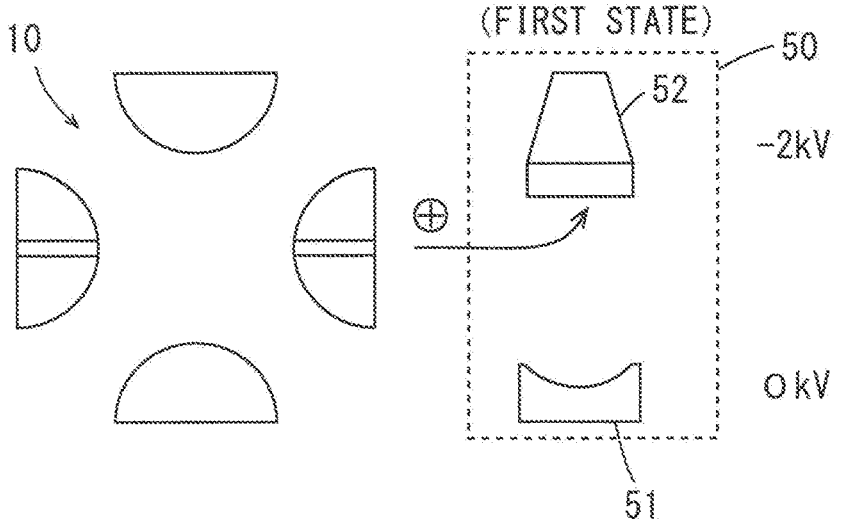
FIG. 4 is a schematic diagram illustrating another example of the first state of the detector voltage.

FIG. 4 is a schematic diagram illustrating another example of the first state of the detector voltage. In the example of FIG. 4, in the first state of the detector voltage, the dynode voltage applied to the dynode 51 is 0. That is, no voltage is applied to the dynode 51. The multiplier tube voltage applied to the secondary electron multiplier tube 52 is a negative voltage (for example, −2 kV). In this case, most of positive ions ejected from the ion outlet 17 of the ion trap 10 enter into the secondary electron multiplier tube 52, and positive ions hardly enter into the dynode 51. Therefore, electrons hardly enter into the secondary electron multiplier tube 52. Therefore, ions ejected from the ion trap 10 are hardly detected by the ion detector 50. The ion detection capability of the ion detector 50 in the case where the detector voltage is in the first state of FIG. 4 is lower than the ion detection capability of the ion detector 50 in the case where the detector voltage is in the second state of FIG. 2. However, some of ions enter into the dynode 51 and are converted to electrons by the dynode 51. Therefore, there is a possibility that some of ions are detected by the ion detector 50.

In the examples of FIGS. 2-4, in the first state and in the second state, the multiplier tube voltage applied to the secondary electron multiplier tube 52 is kept constant, and the voltage applied to the dynode 51 is switched. In this case, since the ion detection capability of the ion detector 50 is instantly increased by changing the dynode voltage, it is not necessary to consider a time period for stabilizing characteristics of the secondary electron multiplier tube 52.

In a case where negative ions are to be detected, in the second state, a positive dynode voltage is applied to the dynode 51. In this case, the dynode 51 converts negative ions to positive charges, and the secondary electron multiplier tube 52 detects an amount of the positive charges.

(3) First Operation Example of the Ion Trap Mass Spectrometer 1

Figure 5:
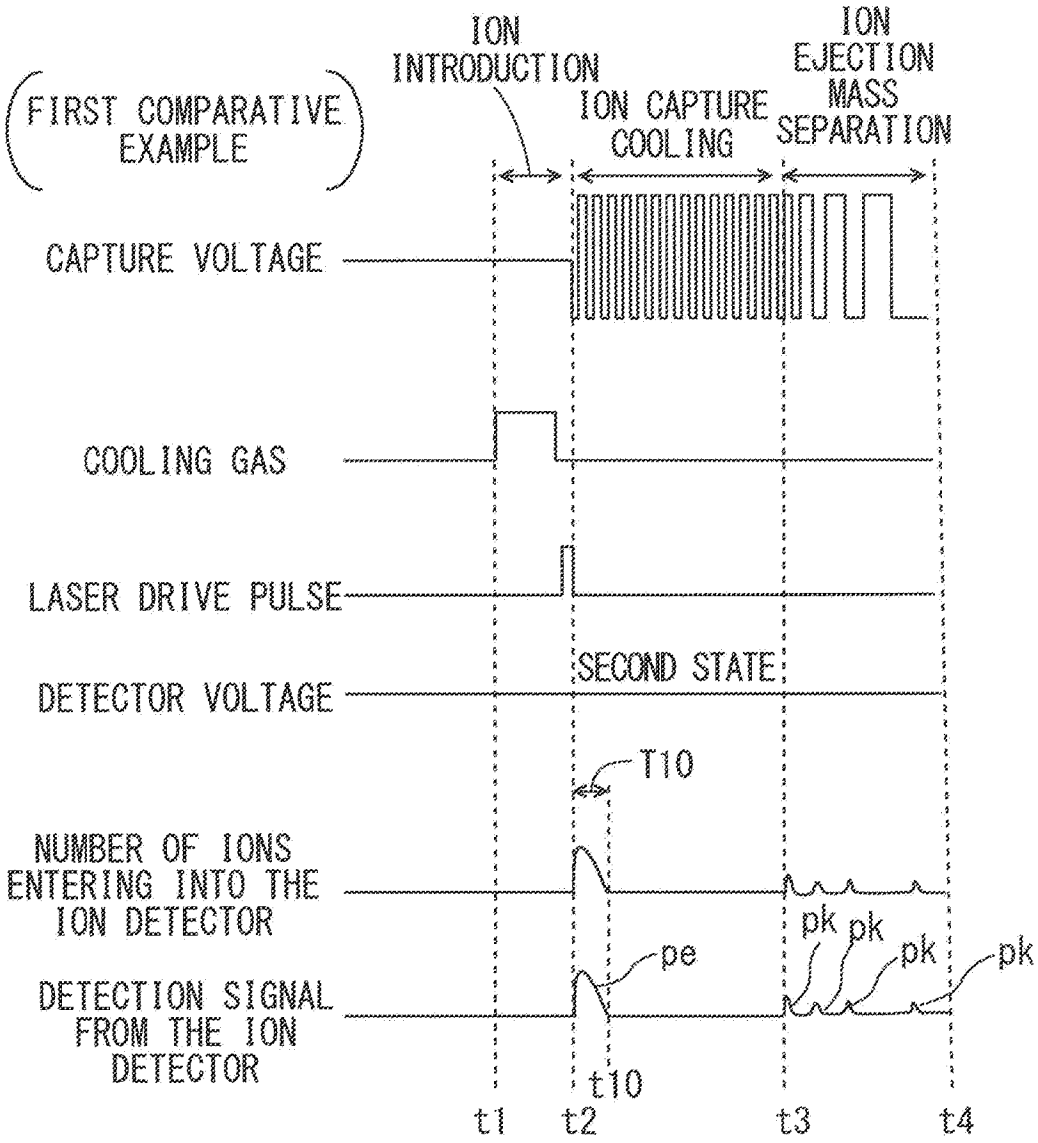
FIG. 5 is a timing diagram illustrating a first comparative example.
Figure 6:
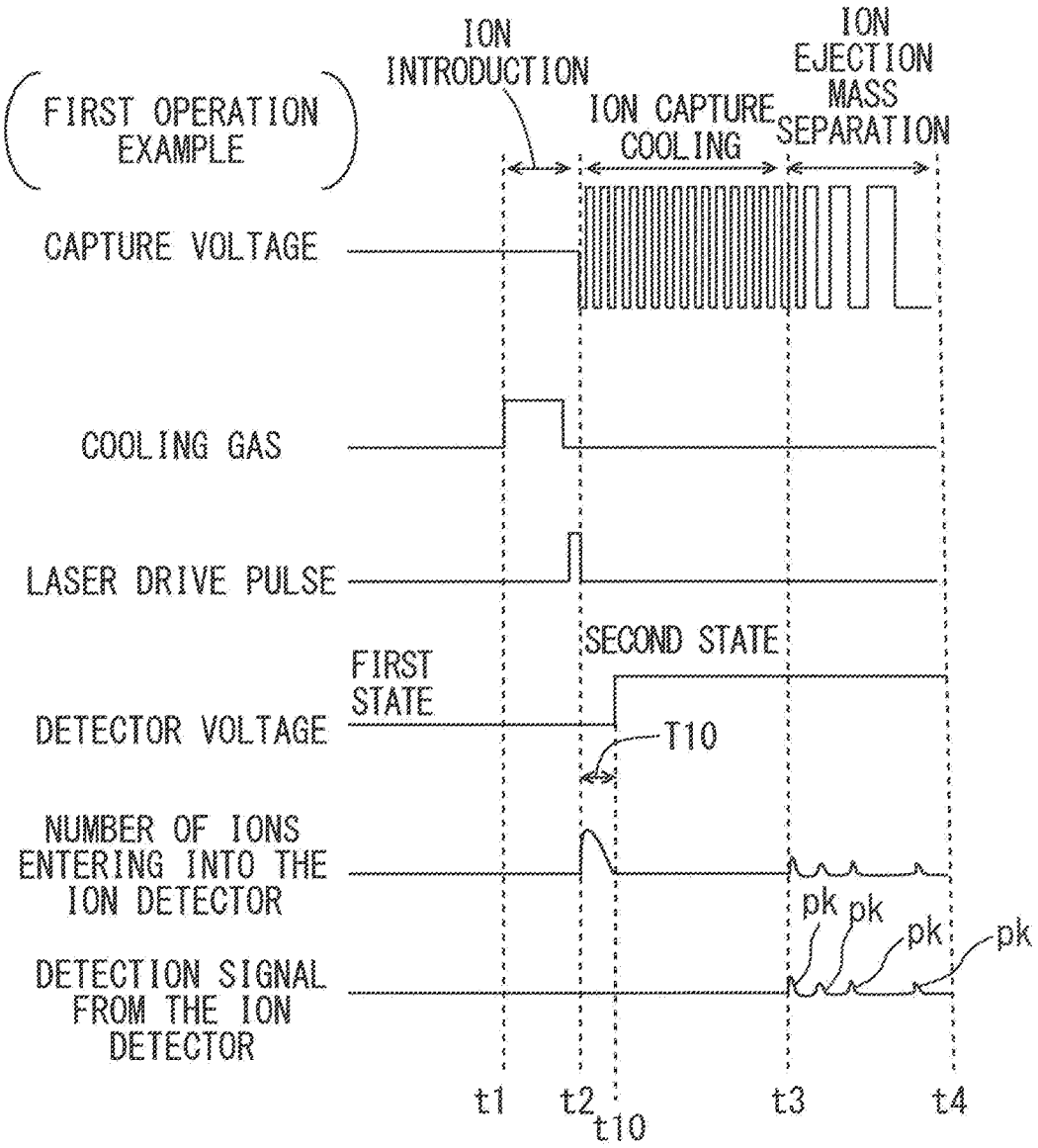
FIG. 6 is a timing diagram illustrating a first operation example of an ion trap mass spectrometer according to the present embodiment.

Next, a first operation example of the ion trap mass spectrometer 1 according to the present embodiment is described in comparison with a first comparative example. FIG. 5 is a timing diagram illustrating a first comparative example. FIG. 6 is a timing diagram illustrating the first operation example of the ion trap mass spectrometer 1 according to the present embodiment. In FIGS. 5 and 6, the capture voltage applied to the ring electrode 11 by the capture voltage generating part 21, supply and not supply of a cooling gas by the cooling gas supply part 19, a laser drive pulse applied to the laser beam irradiation part 31 by the control part 60, the state of the detector voltage applied to the ion detector 50 by the detector voltage generating part 53, the number of ions entered into the ion detector 50, and a detection signal from the ion detector 50 are illustrated. A high level of a waveform of the cooling gas indicates that the cooling gas is supplied, and a low level of the waveform of the cooling gas indicates that the cooling gas is not supplied. Further, a low level of a waveform of the detector voltage indicates the first state, and a high level of the waveform of the detector voltage indicates the second state. The difference between the first operation example of the ion trap mass spectrometer 1 according to the present embodiment and the first comparative example is the change of the detector voltage.

First, the first comparative example is described. As illustrated in FIG. 5, at the start of an operation, the capture voltage generated by the capture voltage generating part 21 is 0, and the detector voltage applied to the ion detector 50 by the detector voltage generating part 53 is in the second state. That is, at the start of the operation, the ion detector 50 is in a state of capable of detecting ions. In the first comparative example, the detector voltage is in the second state from the start (power on) of the operation to the end (power off) of the operation of the ion trap mass spectrometer 1. As a result, the ion detection capability of the ion detector 50 is always high.

A time period from a time point (t1) to a time point (t2) is an ion introduction time period. During the ion introduction time period (t1-t2), the capture voltage applied to the ring electrode 11 by the capture voltage generating part 21 is 0. A cooling gas is supplied from the cooling gas supply part 19 into the ion trap 10. The start of the supply of the cooling gas is 0.1-1 ms before the time point (t2). After that, a laser drive pulse is applied to the laser beam irradiation part 31 by the control part 60. In response to the laser drive pulse, the laser beam irradiation part 31 irradiates a laser beam for a short time to the sample 41. As a result, ions are generated from the sample 41. In the MALDI ion source, a large number of ions derived from the matrix are generated. The generated ions pass through the aperture 35 and are introduced into the ion trap 10 through the ion inlet 16 while being converged by an electric field formed by the einzel lens 34.

A time period from the time point (t2) to a time point (t3) is an ion capture and cooling time period (hereinafter, abbreviated as a cooling time period). The cooling time period (t2-t3) is, for example, a few 100 ms. During the cooling time period (t2-t3), the capture voltage generating part 21 applies as the capture voltage a rectangular wave voltage having a predetermined frequency to the ring electrode 11. As a result, a capture electric field is formed that captures the ions in ion trap 10 while causing the ions to vibrate. The time point (t2) at which the application of the capture voltage is started is, for example, 0.01 ms after the irradiation of the laser beam. The ions introduced into the ion trap 10 have relatively large kinetic energies. The ions in the ion trap 10 collide with the cooling gas, and thereby, the kinetic energies of the ions are reduced. As a result, the ions are likely to be captured in a capture region 18 in the ion trap 10.

However, ions of a low mass-to-charge ratio (m/z) range (for example, m/z=500 or less) are not captured by the ion trap 10 but are ejected from the ion outlet 17 and enter into the ion detector 50. In the case where the detector voltage is in the second state, ions entered into the ion detector 50 are guided to the dynode 51, and electrons are generated. The electrons generated by the dynode 51 enter into the secondary electron multiplier tube 52, and a peak (pe) corresponding to ions in a low mass-to-charge ratio (m/z) appears in a detection signal from the secondary electron multiplier tube 52. A low mass-to-charge ratio (m/z) range is outside an analysis target range. By discharging the cooling gas, a degree of vacuum in the ion trap 10 is restored to a predetermined value. A time period (T10) is a time period during which ions having a low mass-to-charge ratio outside the analysis target range are ejected from the ion trap 10 during the cooling time period (t2-t3).

A time period from the time point (t3) to a time point (t4) is an ion ejection and mass separation time period. During the ion ejection and mass separation time period (t3-t4), in the state in which the above-described rectangular wave voltage is applied to the ring electrode 11, a high frequency signal of a predetermined frequency is applied to the end cap electrodes (12, 13) by the auxiliary voltage generating part 22. As a result, ions having a specific mass are resonantly excited (excited). The resonantly excited ions are ejected from the ion outlet 17, and are detected by the ion detector 50.

The control part 60 changes the frequency of the capture voltage applied to the ring electrode 11 by the capture voltage generating part 21 and the frequency of the auxiliary voltage applied to the end cap electrodes (12, 13) by the auxiliary voltage generating part 22. As a result, the mass-to-charge ratio of the ions ejected from the ion outlet 17 sequentially changes. In this way, mass separation of the ions is performed. During the ion ejection and mass separation time period (t3-t4), a peak (pk) corresponding to ions having a mass-to-charge ratio within the analysis target range appears in a detection signal from the ion detector 50.

According to the first comparative example, as illustrated in FIG. 5, during the initial time period (T10) of the cooling time period (t2-t3), ions having a mass-to-charge ratio outside the analysis target range ejected from the ion trap 10 are detected by the ion detector 50. During the time period (T10), the number of ions outside the analysis target range ejected from the ion trap 10 is larger than the number of ions in the analysis target range. Therefore, due to the ions outside the analysis target range, the ion detector 50 deteriorates.

On the other hand, in the first operation example, as illustrated in FIG. 6, at the start of the operation, the detector voltage applied to the ion detector 50 by the detector voltage generating part 53 is in the first state. As a result, at the start of the operation, the ion detector 50 is in a state of hardly detecting ions. That is, the ion detection capability of the ion detector 50 is low.

During the initial time period (T10) of the cooling time period (t2-t3), ions of a low mass-to-charge ratio range (for example, m/z=500 or less) are not captured by the ion trap 10 but are ejected from the ion outlet 17 and enter into the ion detector 50. In this case, in the first operation example, since the detector voltage is in the first state, most of the ions entered into the ion detector 50 are not guided to the dynode 51. Therefore, the ion detector 50 hardly detects ions. At a time point (t10) at which the time period (T10) ends, the detector voltage enters the second state. As a result, the ion detector 50 can detect ions. That is, the ion detection capability of the ion detector 50 is increased.

During the ion ejection and mass separation time period (t3-t4), ions having a mass-to-charge ratio within the analysis target range are detected by the ion detector 50. A peak (pk) corresponding to the ions having a mass-to-charge ratio within the analysis target range appears in a detection signal from the ion detector 50.

According to first operation example of the ion trap mass spectrometer 1 of the present embodiment, during the initial time period (T10) of the cooling time period (t2-t3), ions having a mass-to-charge ratio outside the analysis target range ejected from the ion trap 10 are hardly detected by the ion detector 50. Therefore, deterioration of the ion detector 50 due to ions outside the analysis target range is suppressed.

(4) Second Operation Example of the Ion Trap Mass Spectrometer 1

Figure 7:
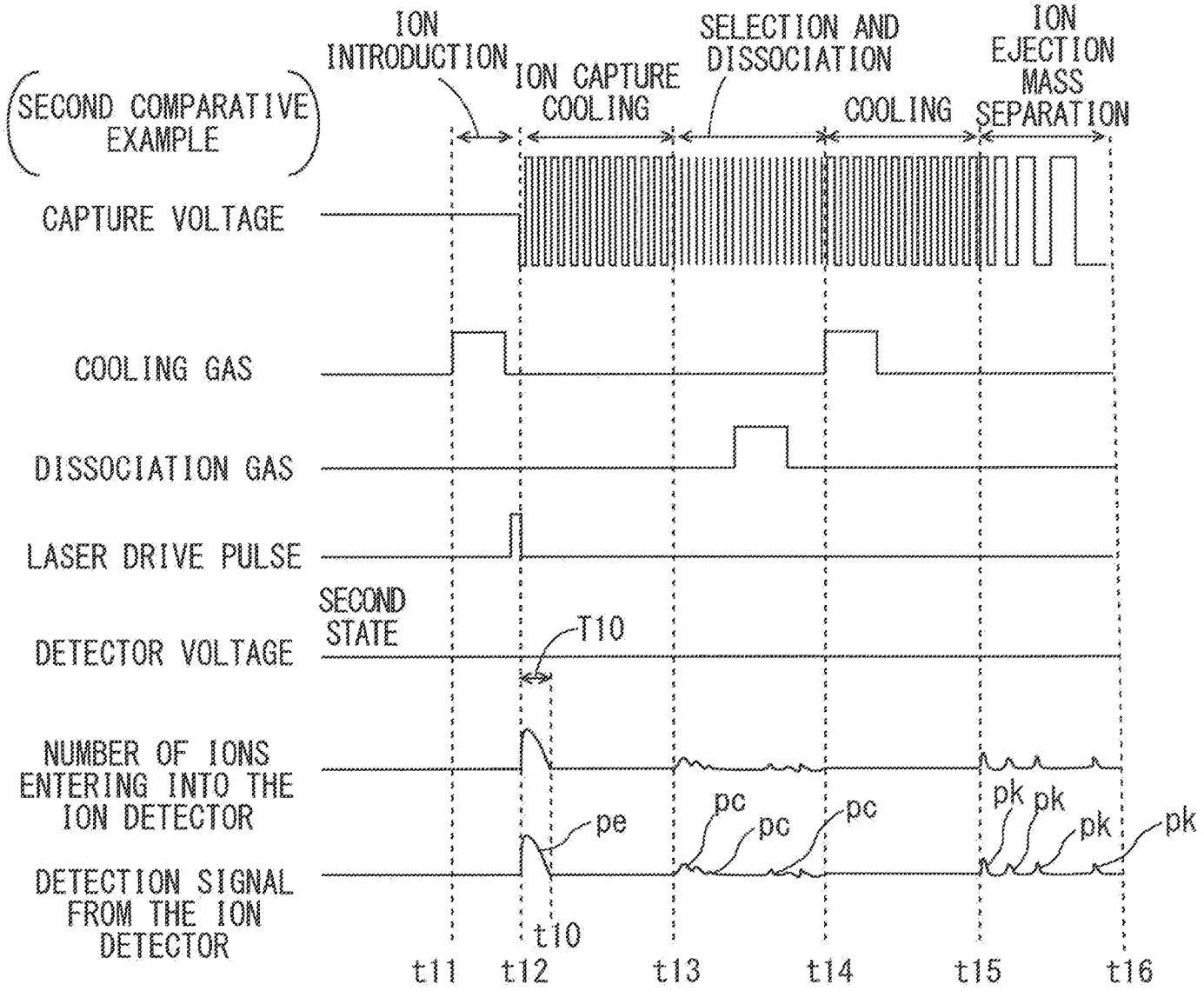
FIG. 7 is a timing diagram illustrating a second comparative example.
Figure 8:
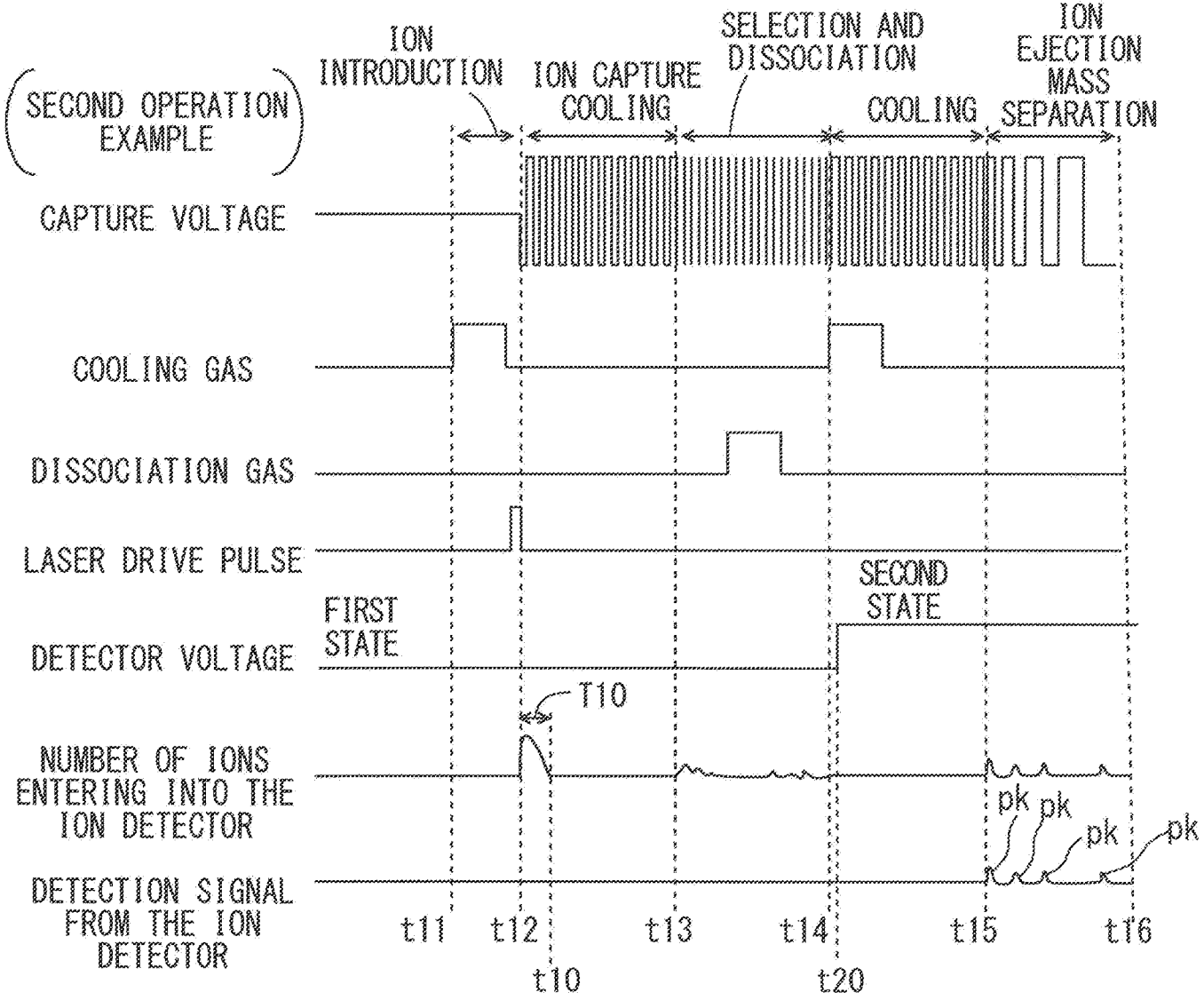
FIG. 8 is a timing diagram illustrating a second operation example of the ion trap mass spectrometer according to the present embodiment.

Next, a second operation example of the ion trap mass spectrometer 1 according to the present embodiment is described in comparison with a second comparative example. FIG. 7 is a timing diagram illustrating the second comparative example. FIG. 8 is a timing diagram illustrating the second operation example of the ion trap mass spectrometer 1 according to the present embodiment.

In FIGS. 7 and 8, in addition to the capture voltage, supply and not supply of a cooling gas, a laser drive pulse, the state of the detector voltage, the number of ions entered into the ion detector 50, and a detection signal from the ion detector 50, supply and not supply of a dissociation gas is also illustrated. A high level of a waveform of the dissociation gas indicates that the dissociation gas is supplied, and a low level of the waveform of the dissociation gas indicates that the dissociation gas is not supplied. The second operation example and second comparative example are MS/MS operations. The difference between the second operation example of the ion trap mass spectrometer 1 according to the present embodiment and the second comparative example is the change of the detector voltage.

Operations during an ion introduction time period (t11-t12) and a first cooling time period (t12-t13) in the second operation example and the second comparative example are respectively the same as the operations during the ion introduction time period (t1-t2) and the cooling time period (t2-t3) in the first operation example and the first comparative example.

First, the second comparative example is described. As illustrated in FIG. 7, the detector voltage applied to the ion detector 50 by the detector voltage generating part 53 is in the second state. That is, at the start of the operation, the ion detector 50 is in a state of capable of detecting ions.

In the second comparative example, the detector voltage is in the second state from the start (power on) of the operation to the end (power off) of the operation of the ion trap mass spectrometer 1. As a result, the ion detection capability of the ion detector 50 is always high.

A time period from a time point (t13) to a time point (t14) is a selection and dissociation time period. During the selection and dissociation time period (t13-t14), a predetermined voltage is applied to the ring electrode 11 by the capture voltage generating part 21. As a result, ions other than target ions having a specific mass-to-charge ratio are resonantly excited. The resonantly excited ions are ejected from the ion trap 10, and are detected by the ion detector 50. As a result, the target ions are selected and captured as precursor ions in the ion trap 10. After a time point (t13), a dissociation gas is supplied into the ion trap 10 by the dissociation gas supply part 20. Due to collision of the precursor ions in the ion trap 10 with the dissociation gas, multiple product ions are generated. During the selection and dissociation time period (t13-t14), ions generated along with the selection and dissociation of the precursor ions are ejected from the ion trap 10. A peak (pc) corresponding to the ions ejected from the ion trap 10 appears in a detection signal from the ion detector 50.

A time period from the time point (t14) to a time point (t15) is a second cooling time period. During the second cooling time period (t14-t15), the capture voltage generating part 21 applies as the capture voltage a rectangular wave voltage having a predetermined frequency to the ring electrode 11. As a result, multiple product ions are captured in the ion trap 10. Further, a cooling gas is supplied from the cooling gas supply part 19 into the ion trap 10. Thereby, cooling of the multiple product ions is performed.

A time period from the time point (t15) to a time point (t16) is an ion ejection and mass separation time period. During the ion ejection and mass separation time period (t15-t16), the control part 60 changes the frequency of the capture voltage applied to the ring electrode 11 by the capture voltage generating part 21 and the frequency of a high frequency signal applied to the end cap electrodes (12, 13) by the auxiliary voltage generating part 22. As a result, the mass-to-charge ratio of the ions ejected from the ion outlet 17 sequentially changes. In this way, mass separation of the product ions is performed. During the ion ejection and mass separation time period (t15-t16), a peak (pk) corresponding to product ions having a mass-to-charge ratio within the analysis target range appears in a detection signal from the ion detector 50.

On the other hand, in the second operation example, as illustrated in FIG. 8, at the start of the operation, the detector voltage applied to the ion detector 50 by the detector voltage generating part 53 is in the first state. That is, at the start of the operation, the ion detector 50 is in a state of hardly detecting ions. In this case, the ion detection capability of the ion detector 50 is low.

During the initial time period (T10) of the first cooling time period (t12-t13), ions of a low mass-to-charge ratio range (for example, m/z=500 or less) are not captured by the ion trap 10 but are ejected from the ion outlet 17 and enter into the ion detector 50. In this case, since the detector voltage is in the first state, most of the ions entered into the ion detector 50 are not guided to the dynode 51. Therefore, the ion detector 50 hardly detects ions. Further, in the second operation example, also during the selection and dissociation time period (t13-t14), the detector voltage applied to the ion detector 50 is in the first state. In this case, the ion detection capability of the ion detector 50 is low. Therefore, the ion detector 50 hardly detects ions generated along with the selection and dissociation of the precursor ions. Therefore, a peak corresponding to the ions generated along with the selection and dissociation of the precursor ions does not appear in a detection signal from the ion detector 50.

In the second operation example, at an initial time point (t20) within the second cooling time period (t14-t15), the detector voltage enters the second state. As a result, the ion detector 50 can detect ions. That is, the ion detection capability of the ion detector 50 is increased.

During the ion ejection and mass separation time period (t15-t16), ions having a mass-to-charge ratio within the analysis target range are detected by the ion detector 50. A peak (pk) corresponding to the ions having a mass-to-charge ratio within the analysis target range appears in a detection signal from the ion detector 50.

According to second operation example of the ion trap mass spectrometer 1 of the present embodiment, during the initial time period (T10) of the second cooling time period (t12-t13), ions having a mass-to-charge ratio outside the analysis target range ejected from the ion trap 10 are hardly detected by the ion detector 50. Therefore, deterioration of the ion detector 50 due to ions outside the analysis target range is suppressed.

Further, during the selection and dissociation time period (t13-t14), ions generated along with selection and dissociation are hardly detected by the ion detector 50. Therefore, deterioration of the ion detector 50 due to ions outside the analysis target range is suppressed.

(5) Effect of the Embodiment

According to the ion trap mass spectrometer 1 of the present embodiment, during a time period when ions having a mass-to-charge ratio outside the analysis target range are ejected from the ion trap 10, since the detector voltage of the ion detector 50 is in the first state, the ion detection capability of ion detector 50 is low. As a result, the ions outside the analysis target range are hardly detected by the ion detector 50. On the other hand, during a time period when ions having a mass-to-charge ratio within the analysis target range are ejected from the ion trap 10, since the detector voltage of the ion detector 50 is in the second state, he ion detection capability of the ion detector 50 is increased. As a result, the ions in the analysis target range are surely detected.

In the first operation example, during the cooling time period (t2-t3), after the end of the time period (T10) during which ions having a mass-to-charge ratio outside the analysis target range are ejected from the ion trap 10, the detector voltage changes to the second state. Further, in the second operation example, during the second cooling time period (t14-t15), the detector voltage changes to the second state. Therefore, deterioration of the ion detector 50 due to detection of ions outside the analysis target range is suppressed. As a result, the lifetime of the ion detector 50 can be improved.

Further, in the second operation example, in MS/MS, it is prevented that ions generated along with selection and dissociation of precursor ions are detected by the ion detector 50. Therefore, the lifetime of the ion detector 50 can be improved.

Further, in a case where the example of FIG. 2 is applied as the first state of the detector voltage of the ion detector 50, as compared to a case where the example of FIG. 4 is applied, ions having a mass-to-charge ratio outside the analysis target range are less likely to enter into the secondary electron multiplier tube 52. As a result, deterioration of the ion detector 50 is further suppressed.

(6) Other Embodiments

In the above embodiment, the ion source 30 is an MALDI ion source. However, the present invention is not limited to this. For example, the ion source 30 may be an ion source using electrospray ionization (ESI) or an ion source using atmospheric pressure chemical ionization (APCI).

The ion trap mass spectrometer 1 according to the above embodiment is an MALDI-DIT-MS. However, the present invention is not limited to this. For example, the present invention is also applicable to other ion trap mass spectrometers such as an ion trap time-of-flight (IT-TOF) mass spectrometer.

In the above embodiment, the ion detector 50 using the secondary electron multiplier tube 52 is used. However, the ion detector in the present invention is not limited to this. The ion detector in the present invention may be other ion detectors such as an ion detector using a multichannel plate.

For example, in a case where an ion detector that can detect ions when a predetermined operating voltage is applied is used, it is possible that the operating voltage is not applied during a time period when ions having a mass-to-charge ratio outside the analysis target range are being ejected from the ion trap 10, and the operating voltage is applied to the ion detector 50 after the end of the time period during which the ions having a mass-to-charge ratio outside the analysis target range are ejected from the ion trap 10. In this case, the state in which the operating voltage is not applied to the ion detector 50 (the state in which the operating voltage is 0) corresponds to the first state, and the state in which the operating voltage is applied to the ion detector 50 corresponds to the second state. In this example, the ion detector 50 does not detect ions when the detector voltage is in the first state, and the ion detector 50 detects ions when the detector voltage is in the second state.

In the above embodiment, the detector voltage is switched from the first state to the second state at a preset time point. However, it is also possible that a user can use the input part 80 to change the time point of switching the detector voltage from the first state to the second state according to a type of the sample 41, the capture voltage or the auxiliary voltage, and the like.

The time point of switching the detector voltage from the first state to the second state is not limited to that in the first or second operation example of the above embodiment. For example, it is also possible that, during the second selection and dissociation time period (t13-t14) of the second operation example, the detector voltage is switched from the first state to the second state after the ions generated along with the selection and dissociation of the precursor ions are ejected from the ion trap 10.

Further, it is also possible that the control part 60 changes the time point of switching the detector voltage from the first state to the second state according to the type of the sample 41, the capture voltage or the auxiliary voltage, and the like.

The invention claimed is:

1. An ion trap mass spectrometer, comprising:

an ion source that generates ions of a component in a sample;

an ion trap that captures the ions generated by the ion source;

an ion detector that detects ions ejected from the ion trap; and a voltage application control part comprising circuitry configured to apply a voltage to the ion detector, wherein the circuitry of the voltage application control part is configured to change the voltage applied to the ion detector such that after generation of ions by the ion source is started, an amount of charges output from the ion detector at a time of incidence of ions during a time period when ions having a mass-to-charge ratio outside an analysis target range are ejected from the ion trap is lower as compared to an amount of charges output from the ion detector at a time of incidence of ions during a time period when ions having a mass-to-charge ratio within the analysis target range are ejected from the ion trap.

2. The ion trap mass spectrometer according to claim 1, further comprising:

a cooling part that performs cooling of ions in the ion trap during a first cooling time period after generation of ions by the ion source is started, wherein the circuitry of the voltage application control part is configured to change the voltage applied to the ion detector such that an amount of charges output from the ion detector at a time of incidence of ions is increased during the first cooling time period and after a time period during which ions having a mass-to-charge ratio outside the analysis target range are ejected from the ion trap.

3. The ion trap mass spectrometer according to claim 2, further comprising:

an ion dissociation part that dissociates precursor ions captured in the ion trap during a dissociation time period after the first cooling time period, wherein the cooling part performs cooling of ions in the ion trap during a second cooling time period after the dissociation time period, and the circuitry of the voltage application control part is configured to change the voltage applied to the ion detector such that an amount of charges output from the ion detector at a time of incidence of ions is increased after a time period during which ions having a mass-to-charge ratio outside the analysis target range are ejected from the ion trap and until the second cooling time period ends.

4. The ion trap mass spectrometer according to claim 3, wherein the circuitry of the voltage application control part is configured to change the voltage applied to the ion detector such that an amount of charges output from the ion detector at a time of incidence of ions is increased after a time period during which ions generated along with selection and dissociation of precursor ions during the dissociation time period are ejected from the ion trap, or during the second cooling time period.

5. The ion trap mass spectrometer according to claim 3, wherein the cooling part comprises a cooling gas supply part configured to supply into the ion trap a cooling gas for cooling ions inside the ion trap, and the ion dissociation part comprises a dissociation gas supply part configured to supply into the ion trap a dissociation gas for collision induced dissociation.

6. The ion trap mass spectrometer according to claim 3, wherein the circuitry of the voltage application control part is configured to control the ion source comprising a matrix assisted laser desorption ionization ion source, the ion trap comprising a three-dimensional quadrupole ion trap, the ion detector comprising a dynode configured to convert ions to charges, and a secondary electron multiplier tube configured to detect an amount of the charges converted by the dynode, the cooling part comprising a cooling gas supply part configured to supply into the ion trap a cooling gas for cooling ions inside the ion trap, and the ion dissociation part comprising a dissociation gas supply part configured to supply into the ion trap a dissociation gas for collision induced dissociation.

7. The ion trap mass spectrometer according to claim 6, wherein the ion trap comprises a three-dimensional quadrupole ion trap comprising a ring electrode, a pair of end cap electrodes, an inlet side electric field connection electrode, and an extraction electrode.

8. The ion trap mass spectrometer according to claim 2, wherein the cooling part comprises a cooling gas supply part configured to supply into the ion trap a cooling gas for cooling ions inside the ion trap.

9. The ion trap mass spectrometer according to claim 2, wherein the circuitry of the voltage application control part is configured to control the ion source comprising a matrix assisted laser desorption ionization ion source, the ion trap comprising a three-dimensional quadrupole ion trap, the ion detector comprising a dynode configured to convert ions to charges, and a secondary electron multiplier tube configured to detect an amount of the charges converted by the dynode, and the cooling part comprising a cooling gas supply part configured to supply into the ion trap a cooling gas for cooling ions inside the ion trap.

10. The ion trap mass spectrometer according to claim 9, wherein the ion trap comprises a three-dimensional quadrupole ion trap comprising a ring electrode, a pair of end cap electrodes, an inlet side electric field connection electrode, and an extraction electrode.

11. The ion trap mass spectrometer according to claim l, wherein the ion detector includes a dynode that converts ions to charges, and a secondary electron multiplier tube that detects an amount of the charges converted by the dynode, and the circuitry of the voltage application control part is configured to apply equal voltages to the dynode and the secondary electron multiplier tube during a time period when ions having a mass-to-charge ratio outside the analysis target range are ejected from the ion trap, and to apply different voltages to the dynode and the secondary electron multiplier tube such that electrons move from the dynode to the secondary electron multiplier tube during a time period when ions having a mass-to-charge ratio within the analysis target range are ejected from the ion trap.

12. The ion trap mass spectrometer according to claim 11, wherein the circuitry of the voltage application control part is configured to apply a constant voltage to the secondary electron multiplier tube, and to change a voltage applied to the dynode in order to increase an amount of charges output from the ion detector at a time of incidence of ions.

13. The ion trap mass spectrometer according to claim 1, wherein the ion trap comprises a three-dimensional quadrupole ion trap.

14. The ion trap mass spectrometer according to claim 1, wherein the ion trap comprises a three-dimensional quadrupole ion trap comprising a ring electrode, a pair of end cap electrodes, an inlet side electric field connection electrode, and an extraction electrode.

15. The ion trap mass spectrometer according to claim 14, further comprising:

a capture voltage generating part configured to apply a rectangular wave voltage to the ring electrode of the three-dimensional quadrupole ion trap; and an auxiliary voltage generating part configured to apply a DC voltage or an AC voltage to the pair of end cap electrodes wherein the circuitry of the voltage application control part is configured to control the capture voltage generating part and the auxiliary voltage generating part.

16. The ion trap mass spectrometer according to claim 1, wherein the ion source comprises a matrix assisted laser desorption ionization ion source.

17. The ion trap mass spectrometer according to claim 1, wherein the ion detector includes a dynode configured to convert ions to charges, and a secondary electron multiplier tube configured to detect an amount of the charges converted by the dynode.

18. The ion trap mass spectrometer according to claim 1, wherein the circuitry of the voltage application control part is configured to control the ion source comprising a matrix assisted laser desorption ionization ion source, the ion trap comprising a three-dimensional quadrupole ion trap, and the ion detector comprising a dynode configured to convert ions to charges, and a secondary electron multiplier tube configured to detect an amount of the charges converted by the dynode.

19. The ion trap mass spectrometer according to claim 18, wherein the ion trap comprises a three-dimensional quadrupole ion trap comprising a ring electrode, a pair of end cap electrodes, an inlet side electric field connection electrode, and an extraction electrode.

20. An ion trap mass spectrometry method, comprising:

generating ions of a component in a sample;

capturing the generated ions by an ion trap;

detecting ions ejected from the ion trap by an ion detector; and changing a voltage applied to the ion detector such that, after generation of ions is started, an amount of charges output from the ion detector at a time of incidence of ions during a time period when ions having a mass-to-charge ratio outside an analysis target range are ejected from the ion trap is lower as compared to an amount of charges output from the ion detector at a time of incidence of ions during a time period when ions having a mass-to-charge ratio within the analysis target range are ejected from the ion trap.

* * * * *